US010010167B2

(12) United States Patent
Motahedy

(10) Patent No.: US 10,010,167 B2
(45) Date of Patent: Jul. 3, 2018

(54) MOTORIZED CLEANING SYSTEM FOR A BRUSH

(71) Applicant: Enayatullah Motahedy, Fairfax, VA (US)

(72) Inventor: Enayatullah Motahedy, Fairfax, VA (US)

( * ) Notice: Subject to any disclaimer, the term of this patent is extended or adjusted under 35 U.S.C. 154(b) by 347 days.

(21) Appl. No.: 14/838,861

(22) Filed: Aug. 28, 2015

(65) Prior Publication Data

US 2017/0055694 A1 Mar. 2, 2017

(51) Int. Cl.

| | |
|---|---|
| ***A46B 13/02*** | (2006.01) |
| ***A46B 17/06*** | (2006.01) |
| ***B08B 1/00*** | (2006.01) |
| ***B08B 7/02*** | (2006.01) |

(52) U.S. Cl.

CPC ..... *A46B 17/06* (2013.01); *A46B 13/023* (2013.01); *B08B 1/00* (2013.01); *B08B 7/02* (2013.01)

(58) Field of Classification Search

CPC ..... A46B 13/023; A46B 17/02; A46B 17/06; B08B 7/02

USPC ..... 15/22.1, 94, 257.01, DIG. 9

See application file for complete search history.

(56) References Cited

U.S. PATENT DOCUMENTS

| | | | | |
|---|---|---|---|---|
| 3,771,772 | A | 11/1973 | Honda | |
| 5,283,921 | A * | 2/1994 | Ng | A61C 17/22 15/145 |
| 5,471,695 | A | 12/1995 | Aiyar | |
| 5,711,328 | A | 1/1998 | Braun | |
| 6,569,170 | B1 | 5/2003 | Kellogg | |
| 6,719,850 | B2 | 4/2004 | Glucksman et al. | |
| 6,821,355 | B1 | 11/2004 | Taylor et al. | |
| 7,260,862 | B1 | 8/2007 | DeFilippis | |
| 7,448,398 | B2 | 11/2008 | Glucksman et al. | |
| 7,451,770 | B2 | 11/2008 | Saito et al. | |
| 7,451,772 | B2 | 11/2008 | Gilbert et al. | |
| 7,513,006 | B2 | 4/2009 | Brackett et al. | |
| 8,123,870 | B2 | 2/2012 | Eum | |
| 8,239,991 | B2 * | 8/2012 | Shimizu | A46B 15/0002 15/22.1 |
| 8,522,797 | B2 | 9/2013 | Dickie | |
| 2004/0205914 | A1 | 10/2004 | Holden et al. | |

(Continued)

OTHER PUBLICATIONS www.lilumia.com, LILUMIA, Dec. 3, 2015.

(Continued)

*Primary Examiner* — Randall Chin

(74) *Attorney, Agent, or Firm* — Intella IP; James W. Pravel

(57) ABSTRACT

A brush cleaning system is provided that comprises a device body having a proximal and a distal end. The proximal end of the device body is configured to engage a first point on a handle of a brush at a first engagement point. The distal end of the device body is configured to engage a second point on the handle of the brush at a second engagement point. A vibration producing motor is configured to transmit vibrations to the first engagement point and to the second engagement point wherein the vibrations are transmitted to the bristles on the brush to loosen and remove particulates therefrom. The vibration producing motor can be contained in the device body or it can be contained in the brush handle or a vibration producing motor can be included in both the device body and in the brush handle.

19 Claims, 6 Drawing Sheets

(56) References Cited

U.S. PATENT DOCUMENTS

| | | | |
|---|---|---|---|
| 2004/0250844 | A1 | 12/2004 | Kumazaki |
| 2005/0155622 | A1 | 7/2005 | Leis |
| 2005/0241667 | A1 | 11/2005 | Bodet et al. |
| 2006/0265821 | A1 | 11/2006 | Hause |
| 2007/0023064 | A1 | 2/2007 | Gilbert et al. |
| 2008/0087297 | A1 | 4/2008 | Rahbar-Dehghan |
| 2009/0120471 | A1 | 5/2009 | Ludwiczak |
| 2010/0252077 | A1 | 10/2010 | Muraske |
| 2011/0284024 | A1 | 11/2011 | Trebella et al. |
| 2012/0138093 | A1 | 6/2012 | Sappok et al. |
| 2013/0086757 | A1 | 4/2013 | Holley |
| 2014/0076744 | A1 | 3/2014 | Questiaux et al. |
| 2014/0096801 | A1 | 4/2014 | McCormick et al. |

OTHER PUBLICATIONS

Newport Corporation, Fundamentals of Vibration, www.newport.com/Fundamentals-of-Vibration, Aug. 21, 2015.

Gibson, Constructive and Destructive Interference, www.phys.uconn.edu/~gibson/Notes/Section5_2/Sec5_2/htm, Aug. 21, 2015.

* cited by examiner

MOTORIZED CLEANING SYSTEM FOR A BRUSH

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND

1. Field of the Invention

This invention relates to the field of motorized brush cleaning systems and devices. Specifically, the invention relates to systems and devices for cleaning bristles and other filaments on brushes.

2. Description of the Related Art

In the past, bristles from brushes, such as makeup brushes, hairbrushes, and toothbrushes have been cleaned using devices that physically interact with the bristles. For example, U.S. Pat. No. 7,513,006 uses an internally rotating device to interact with the bristles.

Some devices transmit ultrasonic vibrations to a brush by pressing against the brush while passing cleaning fluid across the brush bristles. For example see US Patent Publication 2004/0250844.

Other devices use ultrasonic wave cavitations in an aqueous medium that contains the object to be cleaned. For example, U.S. Pat. No. 8,123,870 also includes a head that is configured to hold the object to be cleaned in the aqueous medium.

US Patent Publication 2005/0155622 uses a brush on the end of a vibrating body. Pressurized fluid is directed through the bristles of the brush. The device is used to clean various objects and surfaces. US Patent Publication 2011/0284024 also shows a vibrating device having a brush end that is used for cleaning medical components.

Some devices clean makeup brushes by positioning the brushes within a liquid filled chamber and applying vibration or ultraviolet light. For example see US Patent Publications 2014/0096801 and 2007/0023064.

What is needed is a compact, portable system and device that can effectively clean brushes, such as makeup brushes, toothbrushes and other brushes using the advantages of resonant, high frequency oscillations to remove particulates from the bristles of the brushes.

BRIEF SUMMARY OF THE INVENTION

A brush cleaning system and device is provided that comprises a brush cleaning device having a body with a proximal and a distal end. The proximal end of the device body is configured to engage a first point on a handle of a brush at a first engagement point on the device body. The distal end of the device body is configured to engage a second point on the handle of the brush at a second engagement point on the device body. A vibration producing motor is configured to transmit vibrations to the first engagement point and to the second engagement point wherein the vibrations are transmitted to the bristles on the brush to loosen and remove particulates therefrom.

The vibrations are at high oscillating frequencies normally in the range from approximately 20 KHz to approximately 300 KHz.

The motor can be operated on direct current or alternating current.

The cleaning system may include a brush fastener having at least one end. The fastener is anchored to the body of the cleaning system device and it is in a secure engagement with the brush whereby the fastener releasably secures the brush handle to the first and the second engagement points.

A sleeve may also be provided that is positioned outside of the brush to be cleaned and the cleaning system device body such that the sleeve engages the brush handle and the cleaning system device body to secure the brush to the cleaning system device body. The sleeve also ensures that the brush handle is in contact with the first and the second engagement points on the cleaning system device body. The sleeve is normally comprised of a resilient material, such as silicone or other polymers. A loop can be provided on one end of the sleeve such that both the cleaning and the cleaning system device body can be suspended together from the loop.

The brush cleaning system includes the device and the vibration producing motor. The vibration producing motor can be contained in the device body or in the brush handle, or a vibration producing motor can be contained in both the device body and in the brush handle.

The body of the cleaning system device is water resistant so that the cleaning system device body can be immersed in a desired cleaning liquid to assist with the cleaning of the bristles of the brush.

The vibrations produced by the motor can be concentrated at the distal end of the cleaning system device body or they can be transmitted simultaneously at substantially the same amplitude to both the first engagement point and the second engagement point.

The distance between the first engagement point of the cleaning system device body and the second engagement point of the cleaning system device body is configured to allow a portion of the bristle end of the handle of the brush to extend unsupported to permit oscillating vibrations and movement in the bristle end of the handle of the brush and in the bristles of the brush to maximize the efficiency of removal of particulates from the brush bristles.

The first engagement point is formed at the proximal end of the cleaning system device body with an upwardly extending elongation. However, the first engagement point can also be formed from a simple recess or other irregular surface on the body of the cleaning system device.

Also disclosed is a method of making a motorized brush cleaning system wherein the method comprises:

a. Providing a system device body having a proximal and a distal end;

b. Configuring the proximal end of the device body to engage a first point on a handle of a brush at a first engagement point on the device body;

c. Configuring the distal end of the device body to engage a second point on the handle of the brush at a second engagement point on the device body; and d. Transmitting vibrations with a vibration producing motor to the first engagement point and to the second engagement point;

e. Wherein the vibrations are transmitted to the bristles on the brush to loosen and remove particles therefrom.

An additional step can be provided of containing the vibration producing motor within the handle of the brush. An additional step can also be provided of containing the vibration producing motor in the body of the brush cleaning system device.

The inventive cleaning system effectively breaks up and removes particulate matters from brush bristles using high frequency oscillations. The rigorous vibrations at sonic and ultrasonic frequencies promote cleansers to thoroughly profuse into the bristles and other filaments which cleans the particulate matters from the brush. The inventive system further aids in eliminating progressive build-up of unwanted substances.

When two unique waves of equal frequency are transposed in proper orientation on top of each other, they are known as being "in-phase" and combine to increase amplitude ($y_m$). When two waves are in-phase, it is known as constructive interference and is illustrated by the equation: $R_2-R_1=m\lambda$ where m is an integer and $\lambda$ is the wavelength; $R_2-R_1$ represents the distance between the two nodes that produce the waves. If the distance of separation ($R_2-R_1$) is equivalent to an integer multiple (m) of the wavelength ($\lambda$) emitted from the nodes, then there will be fully constructive interference.

The Resonant Angular Frequency of the motorized cleaning system will cause the brush to have the same resonant angular frequency (vibration) as the cleaning system because both the first point and second point on the brush handle are in contact with the cleaning system body. The two points of contact between the cleaning system body and the brush produce two different amplitudes. The combined amplitudes of the waves increase the overall intensity and power of the resulting vibration. Therefore, the bristles on the end of the brush will experience the increased vibrations as an extension of a sinusoidal wave, from the combined amplitudes produced from the two points of contact.

Because the bristle end of the brush extends unsupported beyond the anchor point on the distal end of the device body of the system, the vibrations imposed on the brush at the two contact points causes the bristle end of the brush to resonate as the bristle end of the brush moves up and down. The resonant frequency of the vibrations in the bristles of the brush causes the particles to be released effectively from the brush bristles.

This cleaning system aids in the prevention of bacterial growth and promotes good hygiene. Evidence shows dermal cells that slough off into brush bristles provides an ideal breeding grounds for bacteria to thrive. If an unclean brush is later used, bacteria in the brush bristles can re-enter facial pores. This cleaning system also prevents bacterial growth that is always present after oral brushing. Poor oral hygiene is sometimes linked to bacterial diseases and possibly to life threatening cardiac conditions. By utilizing this cleaning system, one can prevent such bacterial diseases by thoroughly cleaning toothbrushes at high oscillating frequencies.

This cleaning system is applicable to almost all brush products in the cosmetic, dermal hygiene, painting, and oral hygiene industries. This cleaning system promotes the longevity of brush bristles by thoroughly removing stubborn particulates that would otherwise deteriorate the fibers of the bristles. This cleaning system helps promote the resiliency and structural integrity of brushes. It thereby reduces the overall cost of brushes purchased.

DETAILED DESCRIPTION

The following parts list is provided to assist with the understanding of the invention and the illustrated and described embodiments provided herein.

| Part Nbr. | Part |
|---|---|
| B | Brush |
| 12 | Brush bristle |
| 14 | Brush handle |
| 15 | First contact point on brush handle end |
| 16 | Brush motor |
| 17 | Second contact point on brush handle |
| 18 | Brush motor switch |
| D | Cleaning system device |
| 22 | Cleaning system device body |
| 24 | Proximal end of cleaning system device body |
| 26 | Distal end of cleaning system device body |
| E1 | First engagement point |
| E2 | Second engagement point |
| 27 | Cleaning system device motor |
| 28 | Cleaning system device motor switch |
| 29 | Upwardly extending elongation of brush cleaning system device body |
| 32 | Brush fastener |
| 34a/b | Brush fastener anchor point |
| 36 | Brush fastener anchor hole |
| 42 | Sleeve |
| 44 | Sleeve loop |
| V1-V3 | Vibrations at engagement points |
| V4 | Oscillating vibrations |
| L | Unsupported bristle end of brush body |

Figure 1:
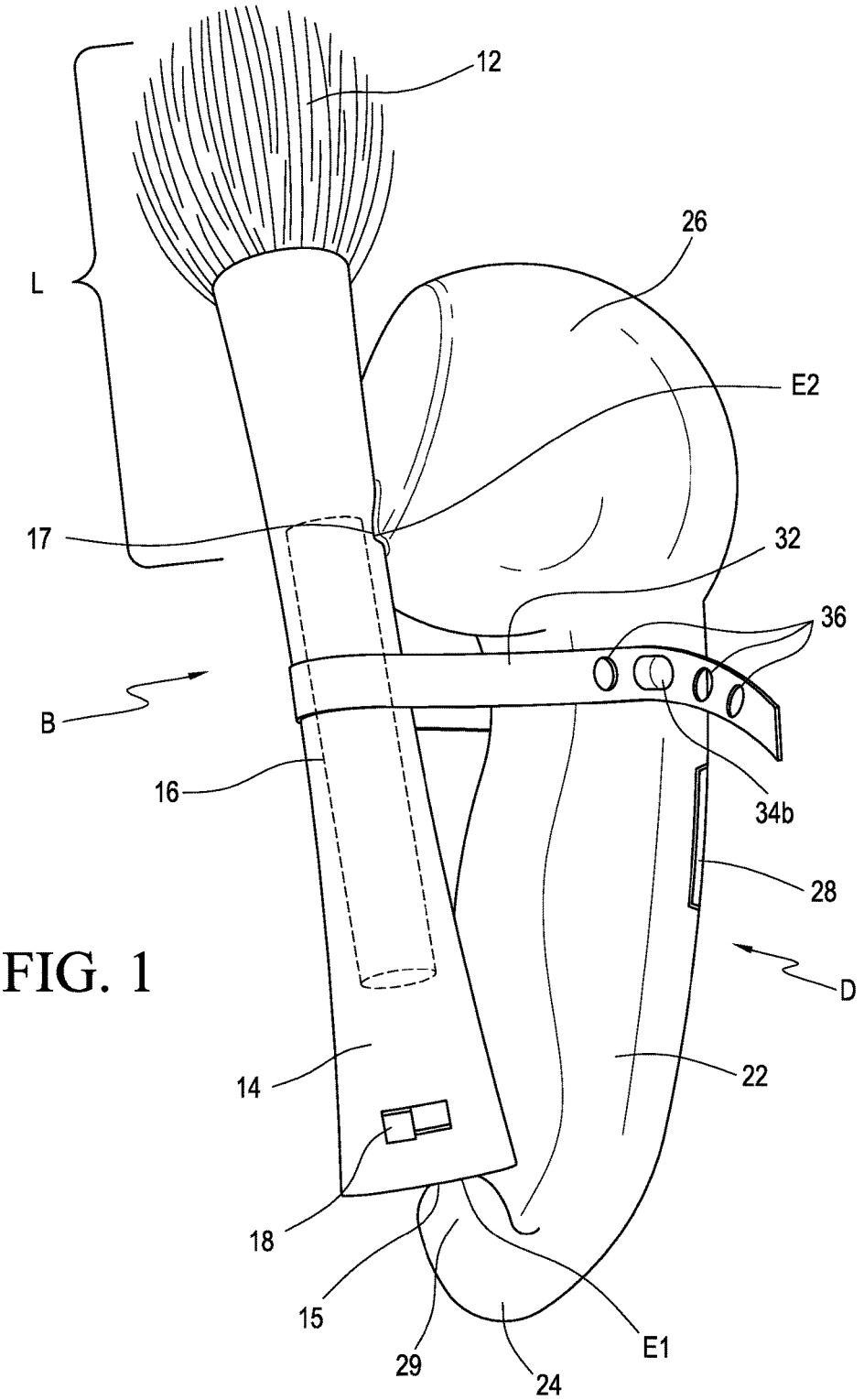
FIG. 1 is an isometric view of the cleaning system including a representative brush mounted on the cleaning system device with the vibration producing motor contained in the brush handle.

Refer now to FIG. 1. A brush B is shown together with the cleaning system device D. The cleaning system device D comprises a body 22 having a proximal end 24 and a distal end 26. The brush B shown is a cosmetics brush, but other brushes include but are not limited to toothbrushes, paint brushes or any other brush that includes bristles.

Figure 3:
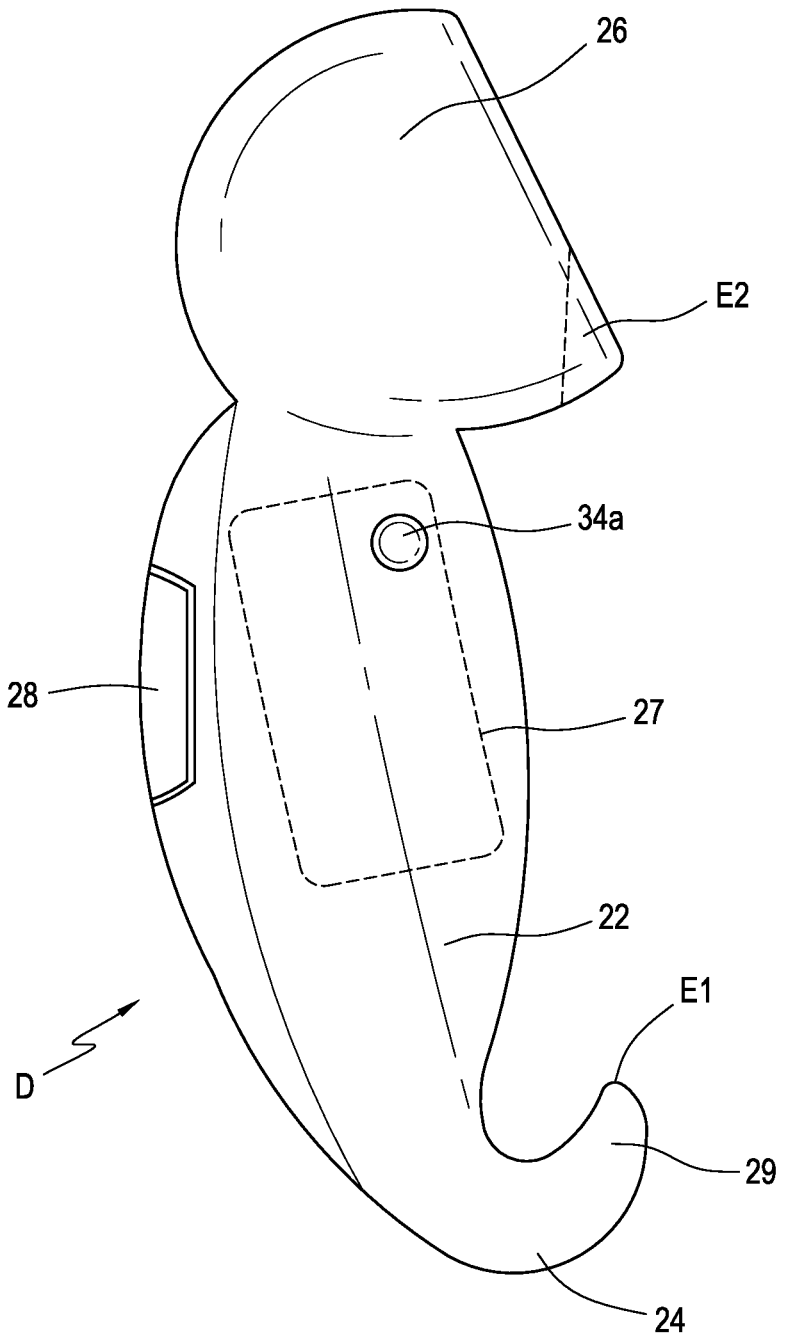
FIG. 3 is a side view of the cleaning system device body showing the vibration producing motor contained in the device body.
Figure 6:
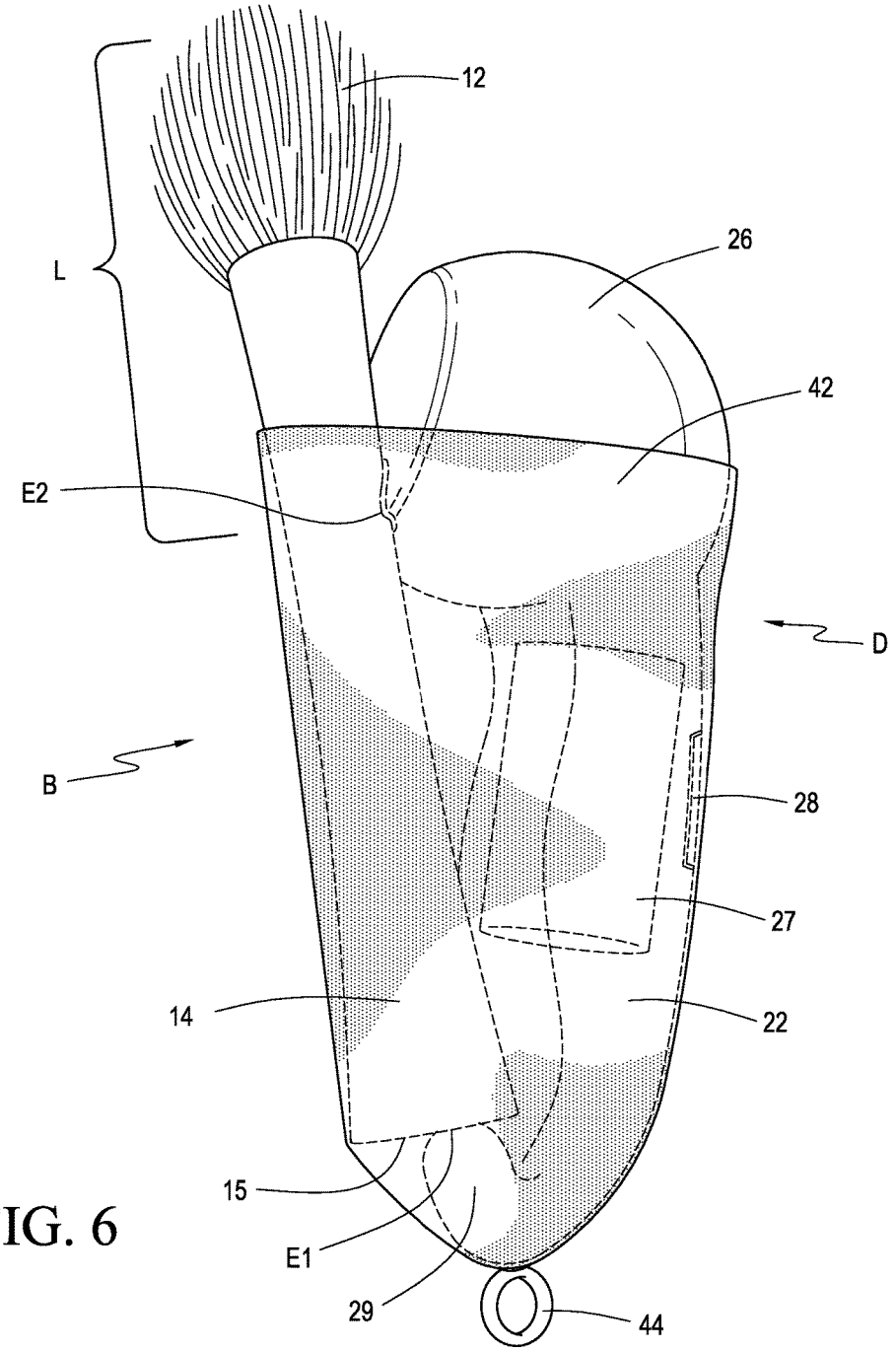
FIG. 6 is an isometric view of the cleaning device showing a sleeve, which secures a brush to the cleaning system device body.

The brush B shown in FIG. 1 includes motor 16, but motor 27 can alternatively or additionally, be provided in the cleaning system device body 22, as shown in FIGS. 3 and 6. Motor 16 is turned on and off with switch 18.

Figure 2:
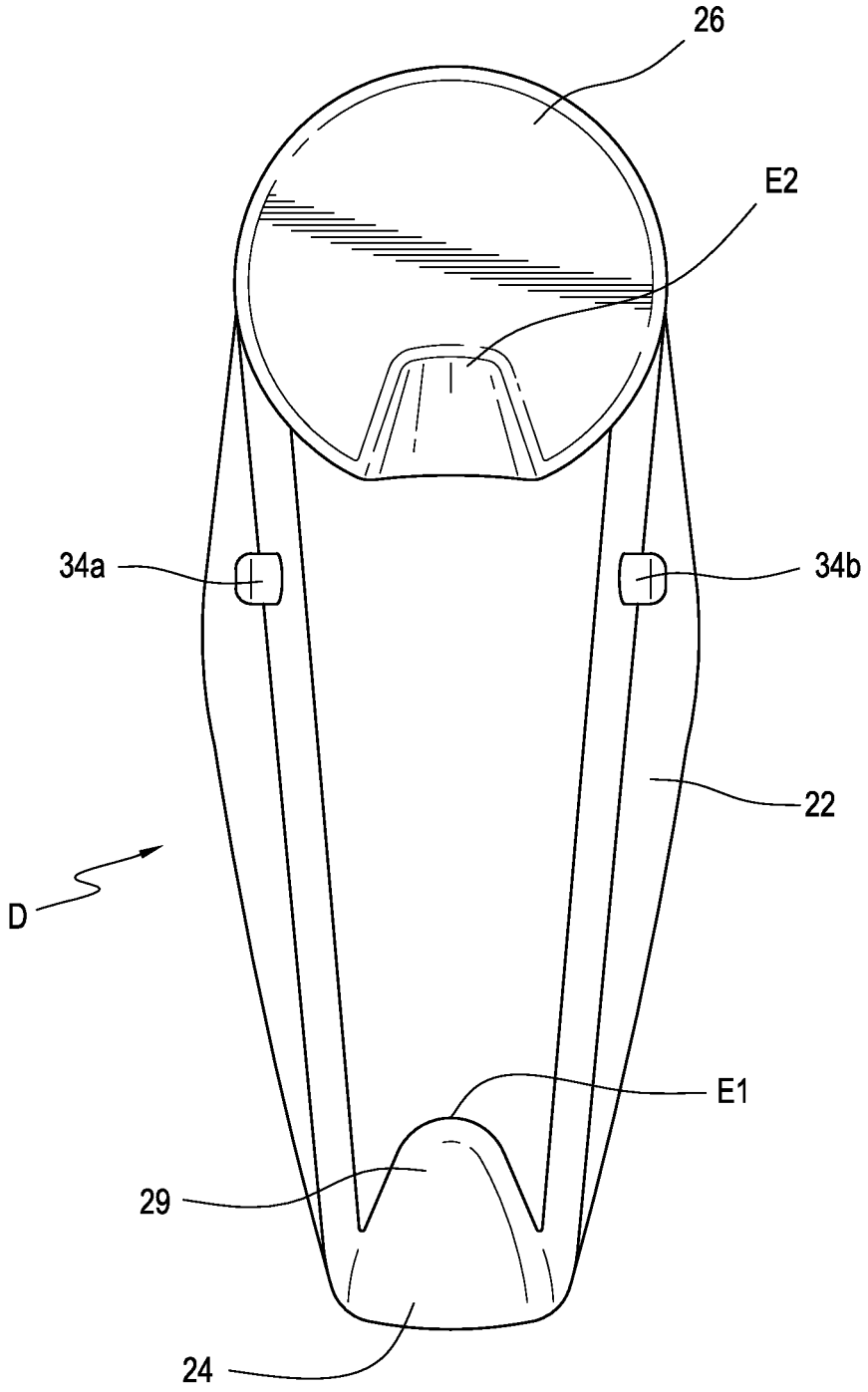
FIG. 2 is a front view of the cleaning system device body.
Figure 4:
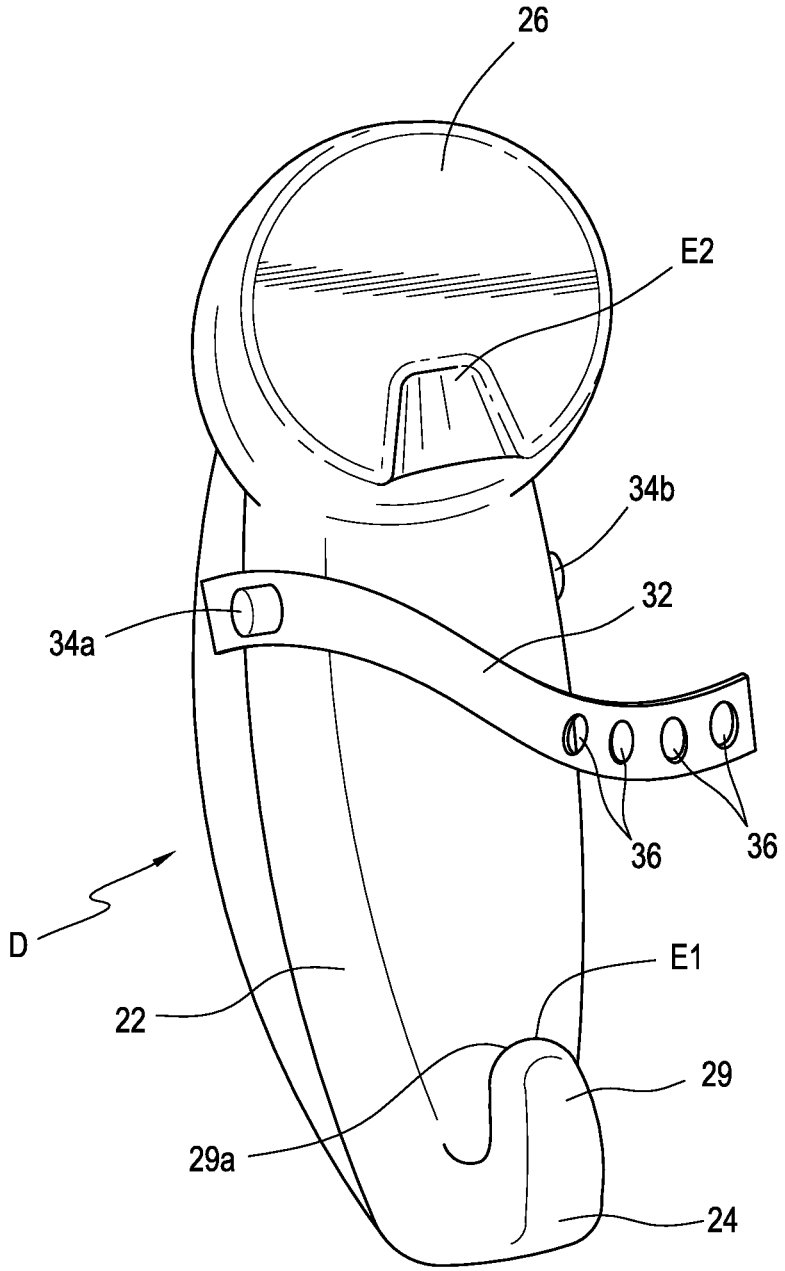
FIG. 4 is an isometric view of the cleaning system device body showing a retaining strap, which secures a brush to the cleaning system device body.

Brush B is removeably attached to the cleaning system device D with brush fastener 32. Brush fastener 32 attaches on one end to anchor point 34*a* (shown in FIGS. 2-4) and on the other end to anchor point 34*b*. One of the brush fastener anchor holes 36 is attached to anchor point 34*b* as is appropriate to securely attach brush B about the brush handle 14 to the cleaning system device body 22. Brush fastener 32 can be made of a resilient material such as a resilient polymer. Alternative fasteners are contemplated to secure the brush B to the cleaning system device body 22. For example, a semi-rigid strap attached at one end to the cleaning system device body 22 and the other end attached to the brush handle 14 could be used. Any other web, strap, hook and loop fastener or other type of securing fastener can be used as long as the fastener secures the brush handle 14 to the cleaning system device body 22 so that first contact point 15 is in contact with the first engagement point E1 and the second contact point 17 is in contact with the second engagement point E2.

Brush handle 14 is engaged at the proximal end 24 of the cleaning system device body 22 at a first point 15 with first engagement point E1. The bristle end of the brush body 14 is engaged with the distal end 26 of the cleaning system device body 22 at a second point 17 with second engagement point E2.

Motor 16 provides vibrations that are transmitted to the first engagement point E1 and to the second engagement point E2. A portion of the bristle end of the brush B extends beyond the second engagement point and is identified as L on FIGS. 1 and 5-6. The end L of brush B extends unsupported beyond the second engagement point E2. The end L is also not in contact with the cleaning system device D and is free to move.

While motor 16 is inside the brush handle 14, alternatively a motor 27 can be provided inside of the cleaning system device body 22, as shown in FIGS. 3 and 6. In either case, vibrations are isolated on the brush at the first engagement point E1 and the second engagement point E2 of the cleaning system device body 22. It is contemplated that additional engagement points can be provided on the cleaning system device body 22. Also, instead of just having a motor 16 in the brush handle 14 or a motor 27 in the cleaning system device body 22, a motor 16 can be included in the brush handle 14 and a motor 27 can simultaneously be included in the cleaning system device body 22. If a motor 16 is provided in the brush handle 14 and motor 27 is included in the cleaning system device body 22, the amplitude of the vibrations at the engagement points E1 and E2 at the first contact point 15 and second contact point 17 will potentially be larger than if there is a motor 16 in only the brush handle 14 or a motor 27 in only the cleaning system device body 22.

The vibrations generated by the motor 16 and/or motor 27 at the first engagement point E1 and the second engagement point E2 will be transmitted to the brush handle 14 at the first contact point 15 and the second contact point 17 and to the unsupported end L of the brush B. The unsupported end L of the brush B will be free to move in all directions and therefore will move vigorously while the brush B is subjected to the vibrations from the motor 16 and/or from the motor 27. The vigorous movement of the end L of the brush B provides similar movement to the bristles 12 on the brush B to remove particulates from the bristles 12.

The motor 16 in the brush handle 14 of brush B is controlled by the brush motor switch 18. The brush motor switch 18 can be a simple on/off switch or it can provide variable voltage to the motor 16 to control the amplitude of vibrations produced by the motor 16. Similarly, motor 27 in the cleaning system device body 22 of the cleaning device D is controlled by the cleaning system device motor switch 28. The cleaning system device motor switch 28 can be a simple on/off switch or it can provide variable voltage to the motor 27 to control the amplitude of vibrations produced by the motor 27.

Motors 16, 27 operate at high oscillating frequencies typically in the range from approximately 20 KHz to approximately 300 KHz, but the frequency range may vary. Power may be provided to motors 16, 27 with direct current batteries, or power can be applied with alternating current.

FIGS. 1-4 and 6 show the first engagement point E1 formed at the proximal end 24 of the cleaning system device body 22 with an upwardly extending elongation 29. The first engagement point E1 can also be formed from a simple indentation in the proximal end 24 of the cleaning system device body 22 or other irregular surface that provides a temporary mounting surface for the first contact point on brush handle end 15 to engage.

FIGS. 1-4 and 6 also show the second engagement point E2 as being a recessed portion on the distal end 26 of the cleaning system device body 22. The second engagement point E2 can be a recess or it can be a minor indentation, or other minor irregular surface that provides an engageable surface for the second contact point 17 on the brush handle 14 to contact the second engagement point E2.

The cleaning system device body 22 can be comprised of a polymer or other composite material. The cleaning system device body 22 is typically water resistant so that it can be immersed in cleaning solution or water while cleaning a brush B. If the brush B includes a motor 16, it is also constructed to be water resistant to protect the motor 16 and any other electronics.

Figure 5:
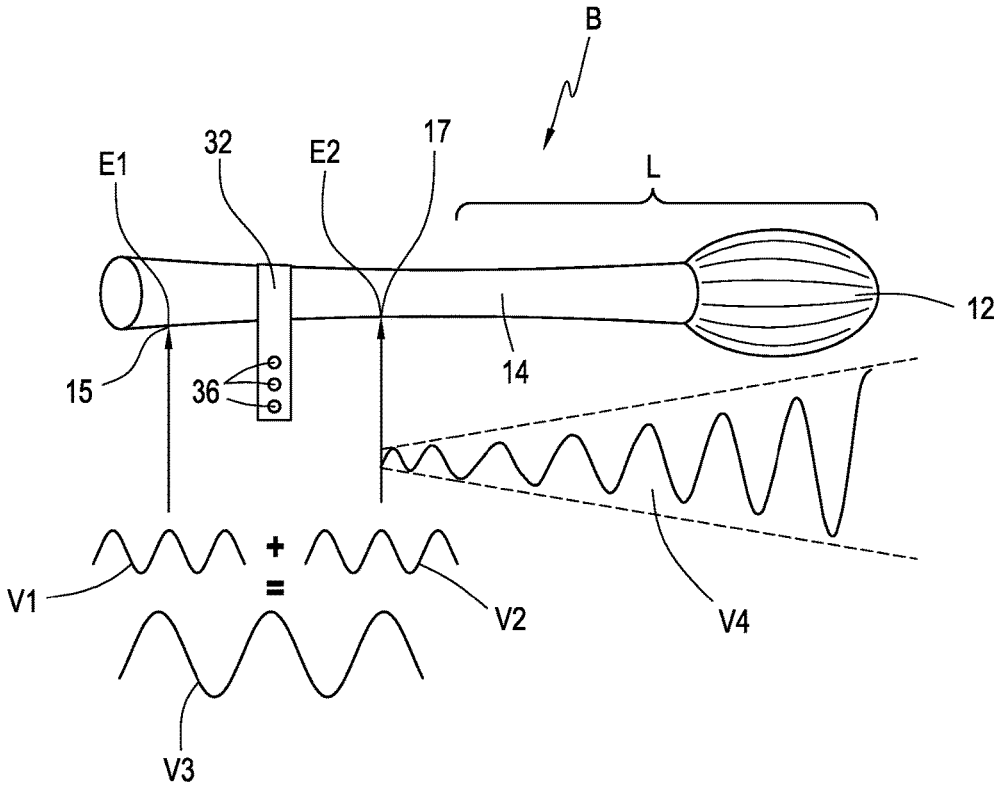
FIG. 5 is a side view of a brush that is cleaned with the cleaning system showing the frequency effects of the engagement points and extended bristle end of the brush.

FIG. 5 shows representative examples of the vibrations produced by motors 16 or 27. The vibration at engagement point E1 is shown as V1 while the vibration at engagement point E2 is shown as V2. V3 shows the effect of adding vibration V1 with V2. Typically V1 and V2 will be the same or nearly the same amplitude so in that case, the amplitude of V3 will be twice the amplitude of V1 and V2.

When two unique waves of equal frequency V1/V2 are transposed in proper orientation on top of each other, they are known as being "in-phase" and combine to increase amplitude ($y_m$). When two waves are in-phase, it is known as constructive interference and is illustrated by the equation: $R_2-R_1=m\lambda$ where m is an integer and $\lambda$ is the wavelength; $R_2-R_1$ represents the distance between the two nodes that produce the waves. If the distance of separation ($R_2-R_1$) is equivalent to an integer multiple (m) of the wavelength ($\lambda$) emitted from the nodes, then there will be fully constructive interference.

The Resonant Angular Frequency of the motorized cleaning system will cause the brush to have the same resonant angular frequency (vibration) as the cleaning system because both the first contact point 15 and second contact point 17 on the brush handle 14 are in contact with the cleaning system body B at the first engagement point E1 and the second engagement point E2. The two points of contact 15, 17 between the cleaning system device D and the brush B produce two different amplitudes V1 and V2. The combined amplitudes of the waves increase the overall intensity and power of the resulting vibration resulting in the amplitude V3. Therefore, the bristles 12 on the end of the brush B will experience the increased vibrations as an extension of a sinusoidal wave V4, from the combined amplitudes produced from the two points of contact.

Because the bristle end of the brush extends unsupported beyond the anchor point on the distal end of the device body of the system, the vibrations imposed on the brush at the two contact points 15, 17 causes the bristle 12 end of the brush B to resonate as the bristle 12 end of the brush B moves up and down. The resonant frequency of the vibrations V4 in the bristles 12 of the brush causes the particles to be released effectively from the brush bristles.

The amplitude of the vibration V4 and the movement of the unsupported brush handle L is at a minimum at the second engagement point E2 while the amplitude of the vibration and the movement of the unsupported brush handle L is at a maximum at the bristle end 12. The result is maximum vibrations and movements are directed to the brush bristles 12 to create an effective and efficient system to remove particulates from the brush bristles 12.

In FIG. 6 a sleeve 42 is shown. The sleeve 42 engages both the brush handle 14 of the brush B and the cleaning system device D and secures the brush B to the cleaning system device D at the engagement points E1 and E2. A brush B can be conveniently stored together with the cleaning system device D, for example while travelling. A loop 44 is typically provided on the sleeve 42 to allow both the brush B and the cleaning system device D to be hung up together on a hanger. The sleeve 42 is typically constructed from a resilient material such as silicone or other polymer. The brush B can also be cleaned while it is contained in the sleeve 42.

Thus specific embodiments and methods of a cleaning system for a brush have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A brush cleaning system comprising:

a. A device body having a proximal and a distal end;

b. Said proximal end of said device body is configured to engage a single first point on a handle of a brush at a single first engagement point on said device body;

c. Said distal end of said body is configured to engage a second point on the handle of the brush at a second engagement point on said device body;

d. A vibration producing motor in said device body is configured to transmit vibrations to the first engagement point and to the second engagement point;

e. Wherein said vibrations are transmitted to bristles on the brush to loosen and remove particulates therefrom.

2. A brush cleaning system according to claim 1 wherein the vibrations are created by oscillating frequencies in the range from approximately 20 KHz to approximately 300 KHz.

3. A brush cleaning system according to claim 1 wherein said motor operates on direct current.

4. A brush cleaning system according to claim 1 wherein said motor operates on alternating current.

5. A brush cleaning system according to claim 1 wherein a brush fastener having at least one end is provided, said fastener is anchored on the at least one end to said device body; and wherein said fastener is in a secure engagement with the brush handle; whereby said fastener releasably secures said brush handle to the first and the second engagement points.

6. A brush cleaning system according to claim 1 wherein a sleeve is provided outside said brush and said cleaning system device body; said sleeve engages said brush handle and said cleaning system device body to secure said brush to said cleaning system device body.

7. A brush cleaning system according to claim 6 wherein a loop is provided on at least one end of said sleeve whereby the cleaning system device body and brush can both be suspended together from the loop.

8. A brush cleaning system according to claim 6 wherein said sleeve is comprised of a resilient material.

9. A brush cleaning system according to claim 8 wherein said sleeve is comprised of silicone material.

10. A brush cleaning system according to claim 1 wherein a brush motor is contained within a body of the brush; and wherein the brush handle engages said cleaning system device body at the first and the second engagement points.

11. A brush cleaning system according to claim 1 wherein said device body is water resistant wherein said device body can be immersed in a desired cleaning liquid to assist with the cleaning of the bristles of the brush.

12. A brush cleaning system according to claim 1 wherein said vibrations are concentrated at the distal end of said device body.

13. A brush cleaning system according to claim 1 wherein said vibrations are transmitted substantially simultaneously at substantially the same amplitude to both the first engagement point and to the second engagement point.

14. A brush cleaning system according to claim 1 wherein the distance between said first engagement point of said device body and said second engagement point of said device body is configured to allow a portion of the bristle end of the handle of the brush to extend unsupported beyond said second engagement point of said device body to permit oscillating vibrations in the bristle end of the handle of the brush and in the bristles of the brush to maximize the vibrations and movement of the bristle end of the brush to efficiently remove particulates from the brush bristles.

15. A method of making a brush cleaning system wherein said method comprises:

a. Providing a device body having a proximal and a distal end;

b. Configuring said proximal end of said device body to engage a single first point on a handle of a brush at a single first engagement point on the device body;

c. Configuring said distal end of said device body to engage a second point on the handle of the brush at a second engagement point on the device body; and d. Transmitting vibrations with a vibration producing motor to the first engagement point and to the second engagement point;

e. Wherein said vibrations are transmitted to the bristles on the brush to loosen and remove particles therefrom.

16. A method of making a brush cleaning system according to claim 15 including the additional step of containing a brush motor within a body of the brush.

17. A method of making a brush cleaning system according to claim 15 including the additional step of containing said motor within the device body of the brush cleaning system.

18. A brush cleaning system comprising:

a. A device body having a proximal and a distal end;

b. Said proximal end of said device body is configured to engage a first point on a handle of a brush at a first engagement point on said device body; wherein said first engagement point is formed at the proximal end of said device body with an elongation;

c. Said distal end of said body is configured to engage a second point on the handle of the brush at a second engagement point on said device body;

d. A vibration producing motor in said device body is configured to transmit vibrations to the first engagement point and to the second engagement point;

e. Wherein said vibrations are transmitted to bristles on the brush to loosen and remove particulates therefrom.

19. A brush cleaning system according to claim 18 wherein said elongation is upwardly extending.

* * * * *